US006675436B1

(12) United States Patent
Fratoni, Jr.

(10) Patent No.: US 6,675,436 B1
(45) Date of Patent: Jan. 13, 2004

(54) VACUUM APPARATUS FOR SALON AND BARBER CHAIRS

(76) Inventor: Anthony R. Fratoni, Jr., 113 Naples Rd., Revere, MA (US) 02151

( * ) Notice: Subject to any disclaimer, the term of this patent is extended or adjusted under 35 U.S.C. 154(b) by 130 days.

(21) Appl. No.: 10/127,749

(22) Filed: Apr. 22, 2002

(51) Int. Cl.[7] ..... A47L 5/38
(52) U.S. Cl. ..... 15/310; 29/463
(58) Field of Search ..... 15/301, 310; 29/463

(56) References Cited

U.S. PATENT DOCUMENTS 3,994,528 A * 11/1976 Humphrey ..... 297/182
5,205,013 A * 4/1993 Lopes ..... 15/301

* cited by examiner

*Primary Examiner*—Terrence R. Till

(74) *Attorney, Agent, or Firm*—Joseph R. Birkner

(57) ABSTRACT

A vacuum apparatus for collecting fallen cut hair from a floor during hair grooming is disclosed. The vacuum apparatus has a base, a suction unit mounted on the base and a shroud removably disposed about the base. The base being separable and having a female portion and a male portion for receiving a post of a chair therebetween the base portions and the portions each having a baffle therein. The shroud being separable and having a plurality of inlet openings throughwhich the cut hair initially passes while being directed by the baffle through the suction unit enroute to a receptacle removably disposed on the suction unit for collection and for subsequent disposal of the cut hair. The female and male portions are engaged in a mating relationship and are maintained therein by a sealant. The shroud, being separable, expandably fits over the base and is kept in place about the base with a hook and a loop type fastener disposed on the shroud. The vacuum apparatus can be readily adapted to fit onto an existing barber and salon chair without modification to the chair so that a floor of a hair grooming shop may be kept clean during hair cutting.

20 Claims, 2 Drawing Sheets

VACUUM APPARATUS FOR SALON AND BARBER CHAIRS

FIELD OF THE INVENTION

This invention relates generally to a vacuum apparatus for salon and barber chairs. More particularly, the present invention relates to a vacuum apparatus for attachment to a barber or to a salon chair for removal of cut hair that collects on the floor of a barber shop or a beauty shop during haircutting.

BACKGROUND OF THE INVENTION

Typically, during haircutting in a beauty shop or barber shop, cut hair, tissues and other debris falls to the floor of the shop where it is allowed to accumulate until the end of the day when it is manually swept away or is hand vacuumed. This is an unhealthy and unsightly condition which may deter customers from returning to the particular shop.

No device is known such as a hose-less vacuum apparatus that readily adapts to a post of a barber chair or to a salon chair and which has a suction unit mounted on a base with a baffle and a shroud which conveniently, efficiently, sanitarily and automatically removes cut hair and debris from the shop floor during the hair cutting process without interrupting the hair cutting process and without allowing the cut hair and debris to accumulate and a vacuum apparatus which is simple in design, versatile and is easy to use.

In view of the above mentioned problems and limitations associated with hair cutting, it was recognized by the present inventor that there is an unfulfilled need for an improved cut hair removal vacuum apparatus that is mountable on a post of a chair which is simple in design, practical, fun to use and is economically manufactured.

Accordingly, it becomes clear that there is a great need for a vacuum apparatus being removably attachable to a salon and to a barber chair with no modification to the chair and one which overcomes the disadvantages associated with removing cut hair from a floor. Such a vacuum apparatus should be one that eliminates the unsanitary accumulation of fallen cut hair on the floor of a barber and a beauty shop and the need to manually sweep and vacuum it therefrom.

SUMMARY OF THE INVENTION

It is therefore an object of this invention to provide a vacuum apparatus for attachment to a salon or barber chair that eliminates the need to manually sweep and hand vacuum cut hair accumulated on the floor of a beauty or barber shop and one which avoids the aforementioned hair cutting problems.

It is an object of this invention to provide a vacuum apparatus which automatically collects floor fallen hair and debris upon operator activation of an electrical switch by directing the cut hair through a plurality of openings in a shroud and through a baffle in a base to a suction unit and collecting the cut hair in a receptacle removably attachable to the suction unit.

It is another object of this invention to provide a vacuum apparatus which is removably attachable to a post of a salon chair and to a post of a barber chair without modification of the chairs and without interfering with the mechanical operation thereof.

It is another object of this invention to provide a vacuum apparatus which collects cut hair in an efficient and in a sanitary manner without the need for a hose or for hose attachments.

It is another object of this invention to provide a vacuum apparatus which has a split base having a female portion and a male portion, a suction device mounted on the base, a receptacle for collecting cut hair, a foot pedal operated electrical switch to activate a motor, a retractable power cord and a separable shroud with openings therein for receiving the cut hair and debris during operation.

It is a further object of this invention to provide a vacuum apparatus which may be manufactured from readily available materials by conventional manufacturing processes.

It is a still a further object of this invention to provide a vacuum apparatus that is simple in design, simple to manufacture, low in cost and fun to use.

This invention results from the realization that there is a great need for a cut hair removal vacuum apparatus that can conveniently be adapted to be used with a conventional barber or salon chair without modification of the chair thereby allowing the vacuum apparatus to be readily retrofitted in the field to the beauty shop and salon chair without modification to the chair. The resulting invention provides a user the capability of conveniently being able to keep the beauty or barber shop clean during the hair cutting operation without the problem of cut hair accumulation.

The above and the other objects are achieved in accordance with the present invention, which, according to a first aspect, provides a vacuum apparatus for collecting fallen cut hair from a floor during hair grooming. The vacuum apparatus has a base being separable and the base having a female portion and a male portion for receiving a post therebetween the portions of the base. The portions each have a baffle therein. A suction unit is mounted on the base and a shroud is removably disposed about the base. The shroud is separable and has a plurality of inlet openings throughwhich the cut hair initially passes while being directed by the baffle through the suction unit enroute to a receptacle removably disposed on the suction unit for collection and for subsequent disposal of the cut hair. There are means for maintaining the female portion and the male portion in a mating relationship about the post when both the shroud and the baffle are in contact with the floor and there are connecting means on the shroud for removably disposing the shroud about the base and about the post.

The second aspect is a special case of the first aspect of this invention with additional features. According to a second aspect of the invention the means for maintaining the female portion and the male portion in a mating relationship about the post when both the shroud and the baffle are in contact with the floor includes a sealant material chosen from the group consisting of caulk, rubber, glue and adhesive backed tape disposed between the female portion and the male portion of the base. The shroud connecting means includes a hook and a loop type fastener disposed on the shroud so that the shroud, being separable, may expand to fit over the base and the post and that the shroud may be kept in place by the connecting means.

According to a third aspect of the invention, disclosed is a method for making a vacuum apparatus for collecting fallen cut hair from a floor during hair grooming in accordance with the teachings of this invention.

1 mounted on a post in close proximity to a bottom member of a chair such as a salon chair with a patron sitting therein shown in phantom.

Figure 2:
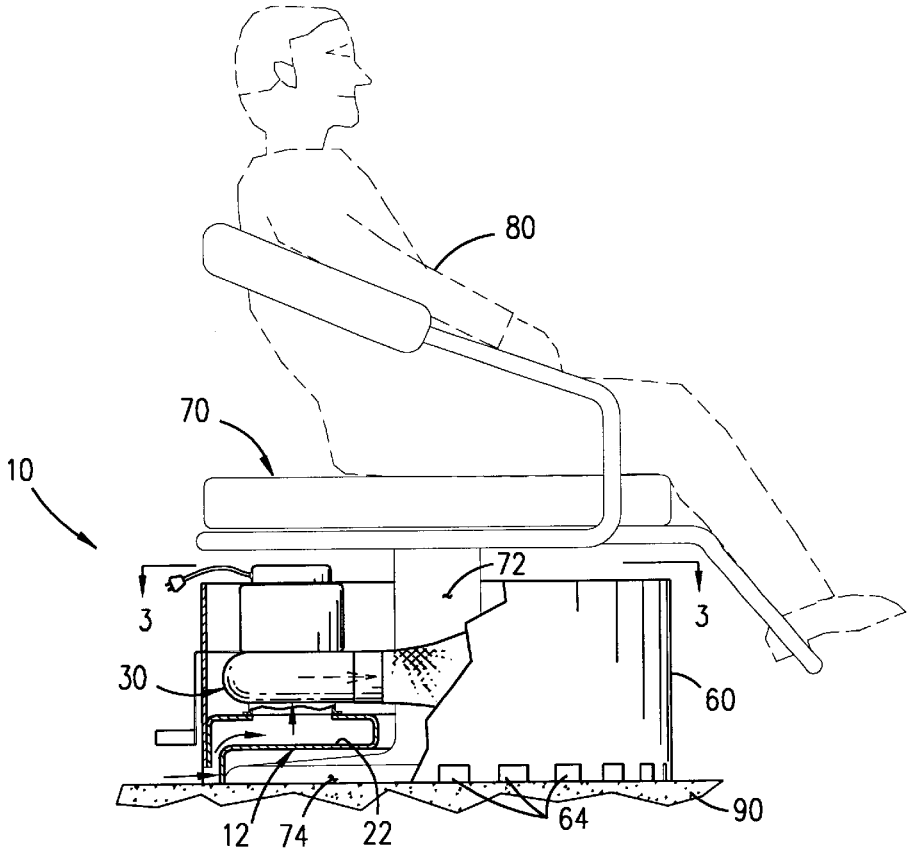
FIG. 2 is a is a partial right side sectional view of a preferred embodiment of the vacuum apparatus 10 of FIG.
Figure 3:
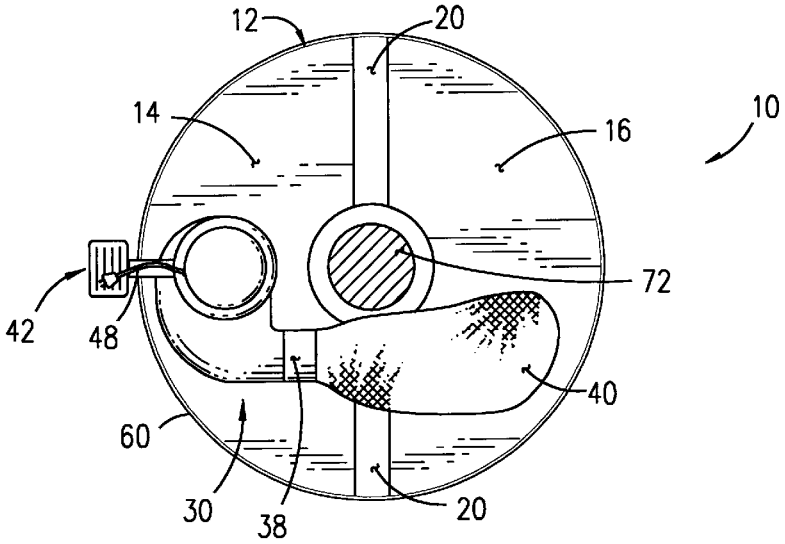

FIG. 3 is view of the vacuum apparatus of FIG. 2 along the plane 3—3 with the post of the salon chair shown in cross section.

DETAILED DESCRIPTION OF PREFERRED EMBODIMENTS

Figure 1:
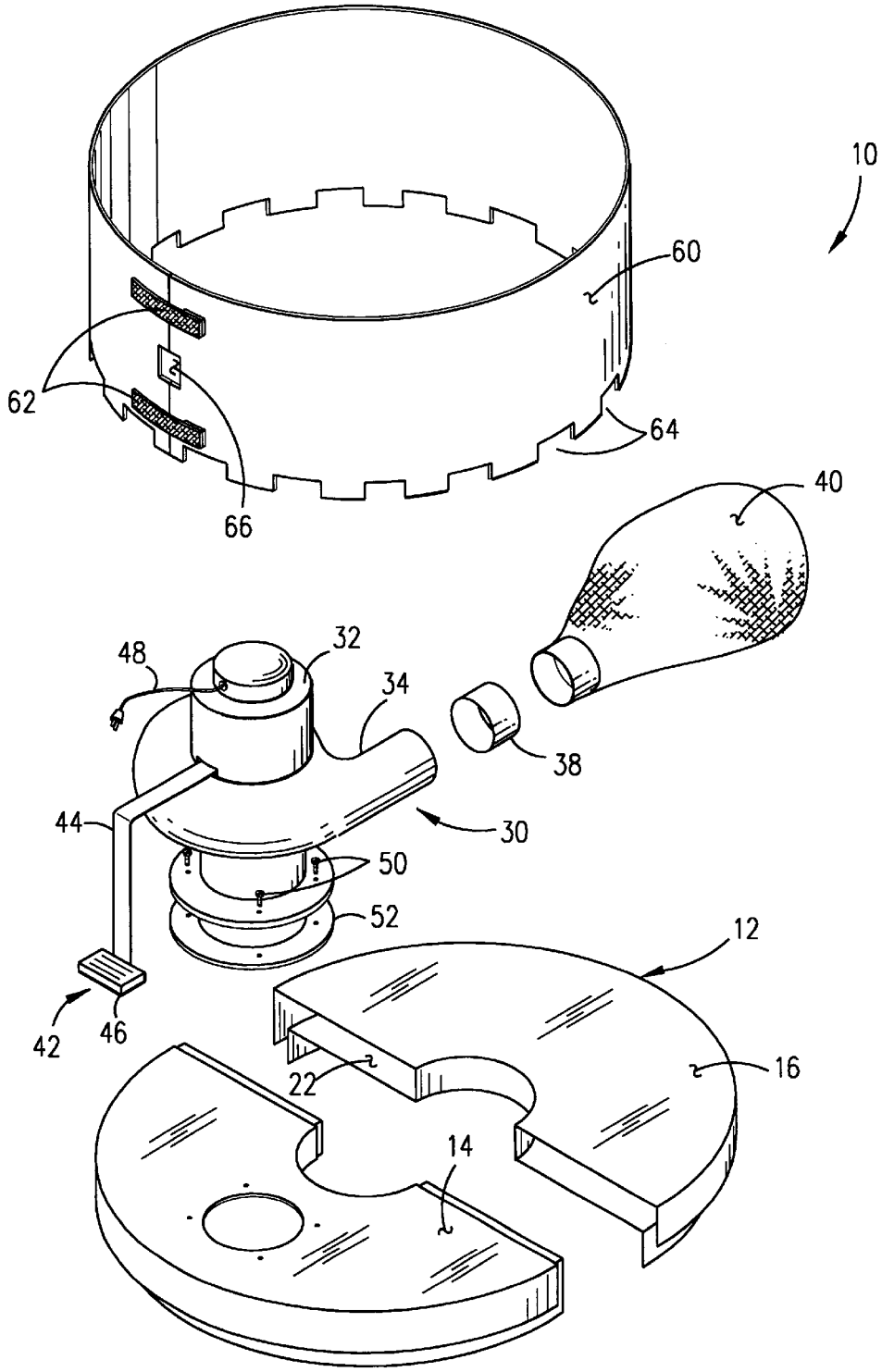
FIG. 1 is an exploded view of a preferred embodiment of a vacuum apparatus of the instant invention showing the components and arrangement thereof

Looking more particularly at the drawings, there is shown in FIG. 1 a preferred embodiment of a vacuum apparatus which is generally indicated at 10, according to a preferred embodiment of the present invention.

FIG. 1 is an exploded view of a preferred embodiment of a vacuum apparatus 10 of the instant invention showing the components and arrangement thereof The major components include a base 12, a suction unit 30 and a shroud 60.

As seen in FIG. 1, base 12 is separable into two parts, a male portion 14 and a female portion 16, each portions being semicircular in shape and defining a circular base when joined together, so that base 12 can be fitted onto a post 72 of a chair 70 best seen in FIG. 2 and in FIG. 3. A baffle 22 cooperating with the suction unit 30 is contained in both portions 14, 16. Construction of base 12 allows male portion 14 and female portion 16 to engage in a mating relationship. Although post 72 can generally be any kind structure or support to which the vacuum apparatus 10 may be operatively attached, such as a lally column or the like where vacuuming is needed such as in a carpentry shop or wherever collection of debris from a floor is needed such as in manufacturing processes; preferably the post 72 is a part of the chair 70. It is understood that the chair 70 referred to herein, may be a barber chair or a salon chair of the type commonly found in a beauty and in a barber shop. Suction unit 30 has a housing 34 with an internal impeller (not shown), a motor 32 with a retractable power cord 48 which may be electrically connected, preferably to a power source such as an A.C. line. It is understood that by suitable selection of the motor 32 and the inclusion of a battery (not shown), which may also be rechargeable, D.C. operation may be readily achieved without departing from the scope of this disclosure. A switch 42, electrically cooperating with the motor 32, preferably foot operated by a user, having a pedal 46 and a lever 44 which passes through a hole 66 in the shroud 60, may be used to conveniently and automatically collect fallen cut hair and debris from the floor 90 of a hair grooming shop without the need to allow the cut hair to accumulate and without the need to manually sweep the cut hair. A receptacle 40 for collecting the cut hair and debris is removably attachable to the housing 34 of the suction unit 30 with a coupling 38. The suction unit 30 is mounted at one of the male portion 14 and the female portion 16 of the base 12 with fasteners 50 and, preferably with a gasket 52 for providing an air tight seal and to dampen any vibration and to absorb any sound from the suction unit 30 during operation. The shroud 60, preferably cylindrical in shape, and being separable along a seam for expansion, has a plurality of openings 64 which are sized and are strategically disposed along a circumference thereof for allowing cut hair and debris to enter when the shroud 60 is placed over the base 12 and about the post 72 in close proximity to a bottom member 74 of the chair 70. There are means for maintaining the female portion 16 and the male portion 14 of the base 12 in a mating relationship about the post 72 when both the shroud 60 and the baffle 22 are in contact with the floor 90 as seen in FIG. 2 which includes a sealant 20 seen in FIG. 3. Sealant 20, preferably is a material chosen from the group consisting of caulk, rubber, glue and adhesive backed tape disposed between the female portion 16 and the male portion 14 of the base 12 to provide an air tight seal therebetween and to further dampen any vibration and to deaden any sound emanating from the suction unit 30 during operation. There are connecting means on the shroud 60 for removably disposing the shroud 60 about the base 12 and about the post 72 which preferably includes a hook and a loop type fastener 62 disposed on the shroud 60.so that the shroud 60, being separable, may expand to fit over the base 12 and the post 72 and that the shroud 60 may be kept in place by the connecting means. Other connecting means may include snaps, buckles and clips.

FIG. 2 is a is a partial right side sectional view of a preferred embodiment of the vacuum apparatus 10 of FIG. 1 mounted on a post 72 in close proximity to a bottom member 74 of a chair 70 such as a salon chair with a patron 80 sitting therein shown in phantom. The vacuum apparatus 10 is positioned so that baffle 22 and shroud 60 each contact floor 90 and so that shroud 60 substantially surrounds suction unit 30 thereby concealing the suction unit 30 from view.

FIG. 3 is view of the vacuum apparatus 10 of FIG. 2 along the plane 3—3 with the post 72 of the salon chair 70 shown in cross section.

Operation is best understood by referring to FIGS. 1 to 3, and particularly by following the arrows shown in FIG. 2 which indicate the direction of flow for collecting cut hair and debris from the floor 90 to the receptacle 40. When the vacuum unit 10 activated by a user, cut hair and debris from the floor 90 enters openings 64 in shroud 60 by suction and is directed about baffle 22 into suction unit 30 and to receptacle 40 for collection. In operation, a user such as a hair dresser or barber can selectively activate the vacuum apparatus 10 during hair cutting so that the cut hair and fallen debris such as paper may be automatically collected without interrupting the hair cutting operation while keeping the floor 90 clean so that it does not have to be swept.

The vacuum apparatus 10 may be fabricated from readily available materials and by conventional fabrication techniques. For example, commercially available vacuum devices may be adapted for use as suction unit 30. Base 12 and shroud 60, from which the vacuum apparatus 10 may be made, is a material chosen from the group consisting of steel, aluminum and plastic. Metal forming and plastic molding may be employed for fabrication of base 12 and shroud 60 as chosen. Shroud 60 may be rolled into a cylindrical shape with an open seam. Assembly of base 12 may be achieved by spot welding, bonding, by heat welding or with adhesives depending upon the material chosen.

Surprisingly, the instant invention provides an added advantage and recognizes a problem and adequately and completely addresses an unfulfilled need, in that a vacuum apparatus 10, in the manner disclosed, in effect, provides a convenient device which eliminates the need to completely sweep a floor at the end of a hair grooming session and provides the desired above mentioned advantages and benefits to a user. The cut hair is readily and conveniently and automatically removed from the immediate vicinity of the chair 70 without interfering with the hair cutting process and without having to rotate the chair 70 to clean around it. Furthermore, the vacuum apparatus 10, collects fallen hair and debris during hair cutting without the need to sweep or vacuum a floor at the end of the hair cutting operation thereby saving time and simultaneously maintaining a sanitary condition.

It is understood that the vacuum apparatus 10 may be constructed in a wide variety of sizes and style variations. For example, the vacuum apparatus 10 may be sized to fit on standard barber and salon chairs, be field installable and be readily removed for servicing. One practical advantage of the invention is that it provides a convenient, practical, low cost, hose-less and attachment-less vacuum apparatus 10 which allows a user to conveniently keep a beauty shop and barber shop clean and attractive to patrons and in compliance with local health and sanitary codes. A further advantage of the invention is that the vacuum apparatus 10 is designed for ease of manufacture by standard methods and by using readily available materials.

Of course, a wide variety of further uses and advantages of the present invention will become apparent to one skilled in the art.

As disclosed, it is apparent that the instant invention can provide other options. One skilled in the art will realize that the foregoing discussion outlines the more important features of the invention to enable a better understanding of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A vacuum apparatus for collecting fallen cut hair from a floor during hair grooming, said vacuum apparatus comprising:

a base being separable and having a female portion and a male portion for receiving a post therebetween said portions of said base;

said portions each having a baffle therein;

a suction unit mounted on said base;

a shroud removably disposed about said base;

said shroud being separable and having a plurality of inlet openings throughwhich the cut hair initially passes while being directed by said baffle through said suction unit enroute to a receptacle removably disposed on said suction unit for collection and for subsequent disposal of the cut hair;

means for maintaining said female portion and said male portion in a mating relationship about the post when both said shroud and said baffle are in contact with the floor, and connecting means on said shroud for removably disposing said shroud about said base and about the post.

2. The vacuum apparatus of claim 1 wherein said maintaining means includes a sealant disposed between said female portion and said male portion of said base for providing an air tight seal therebetween said portions, for vibration isolation and for sound deadening from said suction unit during operation and to facilitate installation and to allow removal of said portions for servicing.

3. The vacuum apparatus of claim 2 wherein said sealant is a material chosen from the group consisting of caulk, rubber, glue and adhesive backed tape.

4. The vacuum apparatus of claim 3 wherein said shroud connecting means includes a hook and a loop type fastener disposed on said shroud so that said shroud, being separable, may expand to fit over said base and the post and that said shroud may be kept in place by said connecting means.

5. The vacuum apparatus of claim 4 wherein said plurality of inlet openings thereon said shroud are sized and are strategically placed to permit the passage of cut hair therethrough.

6. The vacuum apparatus of claim 5 wherein said suction unit further comprising a switch having a lever which passes through a hole in said shroud, a pedal attached to said lever for actuating a motor of said suction unit and a retractable power cord electrically connected to said motor.

7. The vacuum apparatus of claim 6 further comprising a gasket disposed between said suction unit and said base for providing an air tight seal therebetweeen and to dampen any vibration and to absorb any sound from said suction unit during operation and a plurality of fasteners for mounting said suction unit and said gasket to said base.

8. The vacuum apparatus of claim 7 wherein said female portion and said male portion of said base are each semicircular in shape and define a circular shape when said portions are connected to each other.

9. The vacuum apparatus of claim 8 wherein said shroud is cylindrical in shape.

10. The vacuum apparatus of claim 9 wherein said suction unit is substantially contained within said shroud.

11. The vacuum apparatus of claim 10 wherein said base and said shroud each fabricated from a material chosen from the group consisting of steel, aluminum and plastic.

12. A vacuum apparatus adapted to fit on a post of a barber chair for collecting cut hair from a floor which has fallen thereon from a patron seated in the barber chair during hair grooming, said vacuum apparatus comprising:

a base having a female portion and a male portion;

said portions each having a baffle therein;

a suction unit, mounted at one of said male portion and said female portion of said base, for cooperating with said baffle and with the cut hair;

a shroud removably disposed about said base;

said shroud being separable and having a plurality of inlet openings sized and strategically placed to permit the passage of the cut hair therethrough while being directed by said baffle through said suction unit enroute to a receptacle removably disposed on said suction unit for collection and for subsequent disposal of the cut hair;

a sealant, chosen from the group consisting of caulk, rubber, glue and adhesive backed tape, disposed between said female portion and said male portion of said base to maintain said portions in a mating relationship with each other about the post when both said shroud and said baffle are in contact with the floor wherein said sealant chosen for providing an air tight seal therebetween said portions and to dampen any vibration and to deaden any sound emanating from said suction unit during operation and to facilitate installation and to allow removal of said portions for servicing, and connecting means on said shroud for removably disposing said shroud about said base and about the post.

13. The vacuum apparatus of claim 12 wherein said shroud connecting means includes a hook and a loop type fastener disposed on said shroud so that said shroud, being separable, may expand to fit over said base and the post and that said shroud may be kept in place by said connecting means.

14. The vacuum apparatus of claim 13 wherein said suction unit further comprising a switch having a lever which passes through a hole in said shroud, a pedal attached to said lever for actuating a motor of said suction unit and a retractable power cord electrically connected to said motor for operating said vacuum apparatus during the hair grooming operation as needed.

15. The vacuum apparatus of claim 14 further comprising a gasket disposed between said suction unit and said base for providing an air tight seal therebetweeen, to dampen any vibration and to absorb any sound from said suction unit during operation and a plurality of fasteners for mounting said suction unit and said gasket to said base.

16. The vacuum apparatus of claim 15 wherein said shroud and said base each fabricated from a material chosen from the group consisting of steel, aluminum and plastic.

17. A method for making a vacuum apparatus for collecting fallen cut hair from a floor during hair grooming, comprising the steps:

providing a base being separable and having a female portion and a male portion for receiving a post therebetween said portions;

providing each said portions with a baffle;

providing a suction unit for cooperating with said baffle and with the cut hair;

mounting said suction unit on said base;

providing a shroud being separable and having a plurality of inlet openings and connecting means thereon for removably disposing said shroud about said base and about the post;

joining said female portion to said male portion of said base in a mating relationship about the post when said shroud is disposed about said base and both said shroud and said baffle are in contact with the floor, and providing means for maintaining said female portion and said male portion in a mating relationship about the post.

18. The method of claim 17 wherein the step of providing a shroud having connecting means on said shroud for removably disposing said shroud about said base and about the post is achieved by said shroud being separable and cooperatively engageable with a hook and a loop type fastener.

19. The method of claim 18 wherein the step of providing means for maintaining said female portion and said male portion in a mating relationship about the post is achieved by a sealant.

20. The method of claim 19 wherein the step of mounting said suction unit to said base is achieved by providing a gasket and placing said gasket between said suction unit and said base and securing said suction unit to said base with a fastener.

* * * * *